US008047279B2

(12) United States Patent
Barlow et al.

(10) Patent No.: US 8,047,279 B2
(45) Date of Patent: Nov. 1, 2011

(54) SLIP SEGMENTS FOR DOWNHOLE TOOL

(75) Inventors: Joel Barlow, Oologah, OK (US); Jesse Porter, Duncan, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 208 days.

(21) Appl. No.: 12/388,025

(22) Filed: Feb. 18, 2009

(65) Prior Publication Data

US 2010/0206550 A1 Aug. 19, 2010

(51) Int. Cl.
*E21B 33/129* (2006.01)
*E21B 23/06* (2006.01)

(52) U.S. Cl. ..... 166/134; 166/118; 166/216; 166/217

(58) Field of Classification Search ..... 166/118, 166/134, 216, 217
See application file for complete search history.

(56) References Cited

U.S. PATENT DOCUMENTS 4,669,539 A * 6/1987 Barrington ..... 166/120
5,224,540 A 7/1993 Streich et al.
5,271,468 A 12/1993 Streich et al.
5,540,279 A 7/1996 Branch et al.
5,701,959 A 12/1997 Hushbeck et al.
5,806,590 A 9/1998 Lembcke
5,839,515 A 11/1998 Yuan et al.
5,984,007 A 11/1999 Yuan et al.
6,167,963 B1 1/2001 McMahan et al.
6,378,606 B1 4/2002 Swor et al.
6,394,180 B1 5/2002 Berscheidt et al.
6,481,497 B2 11/2002 Swor et al.
6,491,116 B2 12/2002 Berscheidt et al.
6,695,057 B2 2/2004 Ingram et al.
6,708,770 B2 3/2004 Slup et al.
7,048,066 B2 5/2006 Ringgenberg et al.
7,216,700 B2 5/2007 Roberts

* cited by examiner

*Primary Examiner* — Giovanna Wright
(74) *Attorney, Agent, or Firm* — John W. Wustenberg; McAfee & Taft

(57) ABSTRACT

A downhole tool has a mandrel with slip assemblies positioned thereon above and below a packer element. The slip assemblies are positioned in a manner to anchor the downhole tool in the well. The slip assemblies include a slip ring which has a plurality of slip segments. Each slip segment has inserts disposed in cavities therein. The cavities are oriented such that the longitudinal central axis of each cavity is parallel to the longitudinal central axis of each of the other cavities in the slip segment.

14 Claims, 4 Drawing Sheets

SLIP SEGMENTS FOR DOWNHOLE TOOL

BACKGROUND

Downhole tools for use in oil and gas wellbores often have drillable components made from metallic or non-metallic materials, such as soft steel, cast iron, engineering grade plastics, and composite materials.

In the drilling or reworking of oil wells, a great variety of downhole tools are used. For example, but not by way of limitation, it is often desirable to seal tubing or other pipe in the casing of the well, such as when it is desired to pump cement or other slurry down the tubing and force the slurry out into a formation. It thus becomes necessary to seal the tubing with respect to the well casing and to prevent the fluid pressure of the slurry from lifting the tubing out of the well. Downhole tools referred to as packers and bridge plugs are designed for these general purposes and are well known in the art of producing oil and gas.

Bridge plugs isolate the portion of the well below the bridge plug from the portion thereabove. Bridge plugs therefore may experience a high differential pressure and must be capable of withstanding the pressure so that the bridge plug seals the well and does not move in the well after it has been set.

Bridge plugs make use of metallic or non-metallic slip segments, or slips, that are initially retained in close proximity to a mandrel but are forced outwardly away from the mandrel of the tool upon the tool being set to engage a casing previously installed within an open wellbore. Upon the tool being positioned at the desired depth, or position, the slips are forced outwardly against the inside of the casing to secure the packer, or bridge plug as the case may be, so that the tool will not move relative to the casing when, for example, operations are being conducted for tests, to stimulate production of the well, or to plug all or a portion of the well.

Cylindrically shaped inserts, or buttons, may be placed in such slip segments, especially when the slip segments are made of a non-metallic material such as plastic composite material, to enhance the ability of the slip segments to engage the well casing. The buttons must be of sufficient hardness to be able to partially penetrate, or bite into, the surface of the well casing which is typically steel. However, especially in the case of downhole tools being constructed of materials that lend themselves to being easily drilled from the wellbore once a given operation involving the tool has been performed, the buttons must not be so hard or so tough to resist drilling or fouling of the cutting surfaces of the drilling bit or milling bit. The orientation of the slip buttons relative to the casing can also be a factor in the gripping ability of the slip segments.

There is a continuing need for slips that will provide increased gripping and holding ability in the well.

SUMMARY

A downhole tool has a mandrel and an expandable packer element disposed thereabout for sealingly engaging a well. Slip assemblies are positioned on the mandrel above and/or below the packer element to anchor the downhole tool in the well. Each slip assembly comprises a slip ring movable from an unset position to a set position in which the slip ring engages the well. The slip ring comprises a plurality of slip segments. Each slip segment is retained about the mandrel and is movable radially outwardly so that it will engage the well and anchor the tool in the well. A plurality of inserts, or buttons may be secured to the slip segments, and will extend outwardly from the outer surface thereof to grip casing in the well. The inserts are disposed in cavities which preferably are oriented such that the longitudinal central axis of each cavity in an individual slip segment is parallel to the longitudinal central axis of each of the other cavities in that slip segment. The longitudinal axis of each insert in an individual slip segment will thus be parallel to the longitudinal axis of each of the other inserts in that slip segment.

A retaining ring is disposed about the slip ring to retain the slip ring about the mandrel, and may be received in grooves defined in the slip segments that comprise the slip ring. The retaining ring will hold the slip ring in an unset position, and will prevent the slip ring from prematurely moving outwardly to the set position in which the slip ring grippingly engages the casing to hold the tool in the well.

DETAILED DESCRIPTION OF A PREFERRED EMBODIMENT

Figure 1:
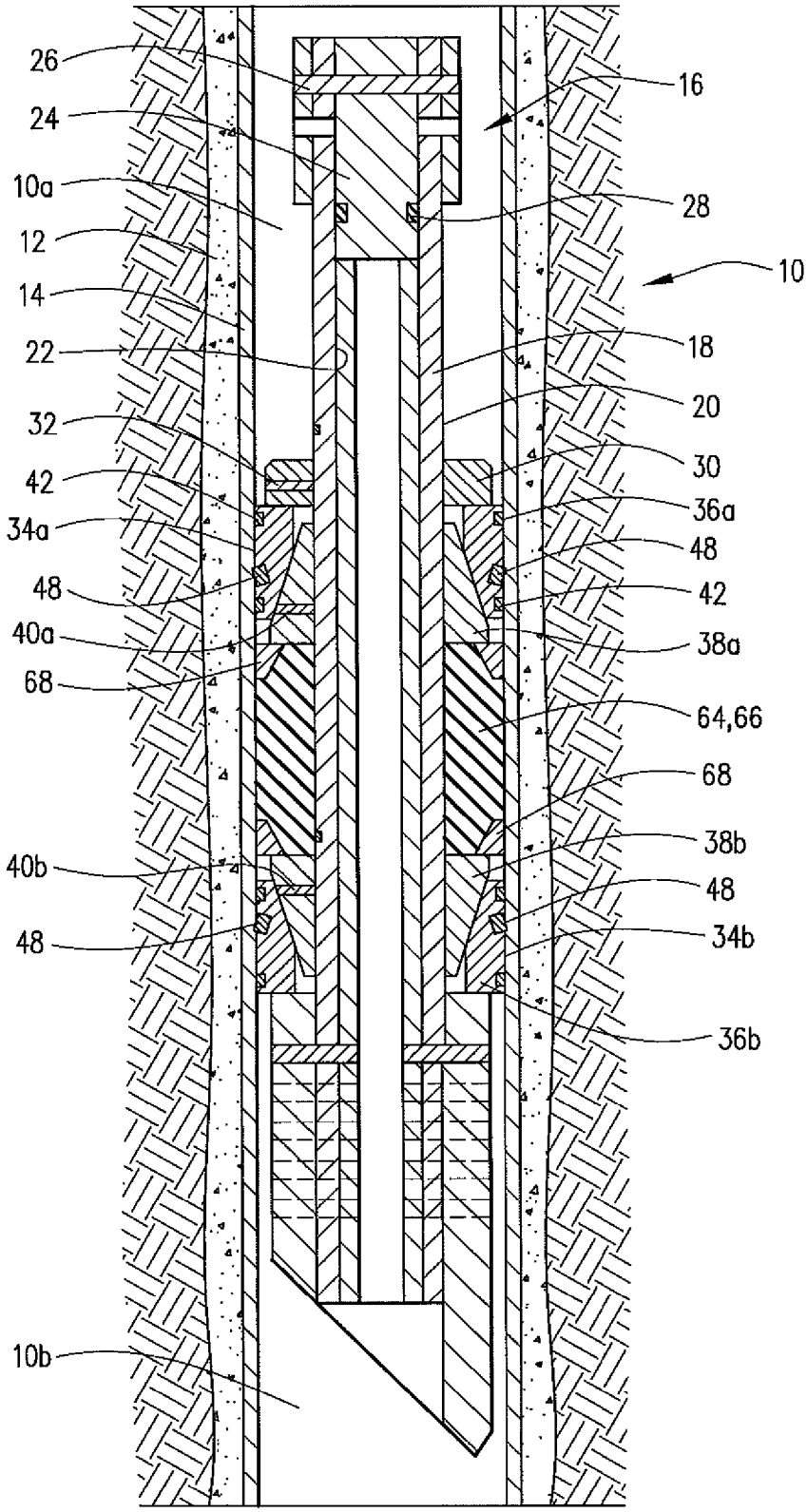
FIG. 1 is a cross section of a downhole tool disposed in a well.

Referring to the drawings, FIG. 1 shows well 10 comprising a wellbore 12 with a casing 14 cemented therein. Downhole tool 16 comprises a mandrel 18 with an outer surface 20 and an inner surface 22. The tool in FIG. 1 may generally be referred to as a bridge plug since downhole tool 16 has an optional plug 24 pinned within mandrel 18 by radially oriented pins 26. Plug 24 has a seal 28 located between plug 24 and mandrel 18. The overall tool structure would be suited for use as and referred to simply as a packer if plug 24 were not incorporated and fluid communication were allowed through the tool. Other components may be connected so that the packer, without plug 24 may be used, for example, as a frac plug.

A spacer ring 30 is mounted to mandrel 18 with a pin 32. A slip assembly 34 is disposed about mandrel 18 and spacer ring 30 provides an abutment which serves to axially retain slip assembly 34. Downhole tool 16 has two slip assemblies 34, namely a first slip assembly and second slip assembly which are shown in the drawings and are designated in the drawings as first and second slip assemblies 34*a* and 34*b* for ease of reference. The slip assemblies will anchor downhole tool 16 in well 10. The structure of slip assemblies 34*a* and 34*b* is identical, and only the orientation and position on downhole tool 16 are different. Each slip assembly 34 includes a slip ring 36 and slip wedge 38 which is pinned into place with pins 40.

Slip ring 36 is an expandable slip ring 36 which has a retaining ring 42 disposed in grooves 44. Retaining ring 42 will retain slip ring 36 in an unset position about mandrel 18 when downhole tool 16 is lowered into the well. Slip rings 36 may be moved or radially expanded from the unset to the set position which is seen in FIG. 1 in which the first and second slip rings 36 engage casing 14 to hold downhole tool 16 in the well. Retaining rings 42 will break as slip rings 36 expand radially outwardly.

Slip rings 36 are comprised of a drillable material and may be, for example, a molded phenolic and have an outer surface 46. Slip rings 36 may be made from other drillable materials as well such as drillable metals, composites and engineering grade plastics. The remainder of the slip assembly and other components of the tool may likewise be made from drillable materials. A plurality of inserts or buttons 48 are secured to slip ring 36 by adhesive or by other means and extend radially outwardly from outer surface 46. The buttons may be cylindrically shaped, and are comprised of material of sufficient hardness to partially penetrate or bite into the well casing and may be comprised, for example, of tungsten carbide or other materials. The buttons may be, for example, like those described in U.S. Pat. No. 5,984,007. In the set position as shown in FIG. 1, buttons 48 will engage or grip casing 14 to hold tool 16 in place.

Figure 2:
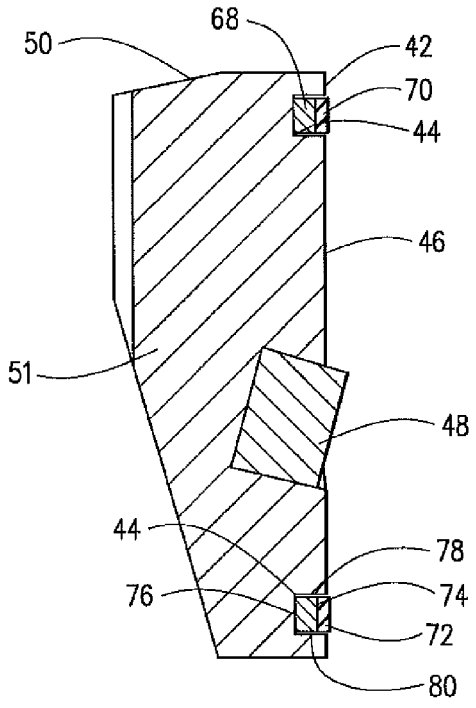
FIG. 2 is an enlarged cross section of a slip segment of the current disclosure.

Each slip ring 36 is preferably comprised of a plurality of slip segments 50. Slip segments 50 are shown in cross section in FIG. 2. Slip rings 36 may include, for example, six to eight slip segments 50 that encircle mandrel 18. Slip ring 36 may include more or less than six or eight segments, and the examples herein are non-limiting. A packer element assembly 60 which includes at least one expandable packer element 62 is positioned between slip wedges 38. Packer shoes 64 may provide axial support to the ends of packer element assembly 60.

Retaining rings 42 are disposed about slip rings 36, and may be received in grooves 44. Retaining rings 42 are each comprised of a retaining band 68, and a dampener, or spring suppressor 70. Retaining band 68 can be used, if desired, without spring suppressor 70, in which case retaining ring 42 will simply comprise retaining band 68. Retaining band 68 may be made from a metal, or may be a composite, such as a fiberglass composite retaining band. The examples provided are not limiting, and retaining band 68 may comprise any material, preferably a drillable material, that will provide adequate strength to prevent premature breakage. Dampener 70 may be made from rubber, for example, a nitrile rubber. Other materials that will dampen or suppress the energy, or spring effect of retaining band 68 may be used. Dampener 70 is affixed to retaining band 68 by, for example, bonding, or molding.

Retaining band 68 may be a ring-shaped band 68, and may have a rectangular cross section with outer surface 72. Outer surface 72 may comprise outer circumferential surface 74, inner circumferential surface 76, and side surfaces 78 and 80. Dampener 70 may be affixed to any or all of surfaces 74, 76, 78 and 80, and may, if desired, completely encapsulate retaining band 68.

Slip segments 50 of the current disclosure are shown in FIGS. 2-6. Slip segments 50 comprise a slip segment body 51 with first and second ends 82 and 84, which may be referred to as abutment end and free end 82 and 84, respectively. Slip segment body 51 has first and second sides 88 and 90, and a forward, or outer arcuate face 92. An arcuate inner surface 93 will preferably have topology complementary to outer surface 20 of mandrel 18.

Buttons, or inserts 48 are secured to slip segment bodies 51 and extend outwardly from outer arcuate face 92. Inserts 48 are secured in cavities 94, which may include first, second and third cavities 96, 98 and 100. While the embodiment shown has three cavities and three inserts 48 in each slip segment body 51, it is understood that more or less cavities and inserts may be utilized. Cavities 96, 98 and 100 have longitudinal axes 101, identified as longitudinal axes 102, 104 and 106, respectively. Buttons 48 are preferably cylindrically shaped buttons with longitudinal central axis 108.

Longitudinal central axes 102, 104 and 106 are parallel, and as such, the longitudinal central axis 108 of each of inserts 48 in a slip segment body 51 is parallel to the longitudinal central axis of the other axes 108 in that slip segment body 51. Longitudinal central axes 102, 104 and 106 will not intersect, and will not intersect the vertical plane in which any of longitudinal central axes 102, 104 and 106 lie. Vertical, as referred to herein, is the up-and-down direction as viewed in FIGS. 1 and 3, and perpendicular to the plane of the page in the end view of FIG. 6. Axis 106 will pass through a diametric center D of the arc defined by surface 92, but axes 102 and 104 will not pass therethrough.

Figure 3:
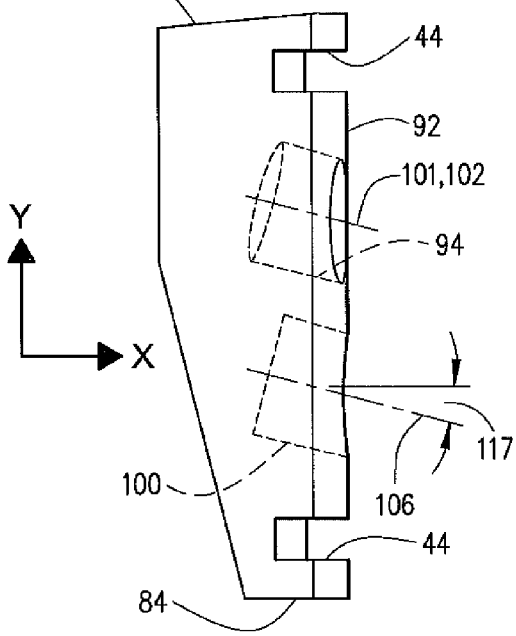
FIG. 3 is a side view of a slip segment of the current disclosure.
Figure 4:
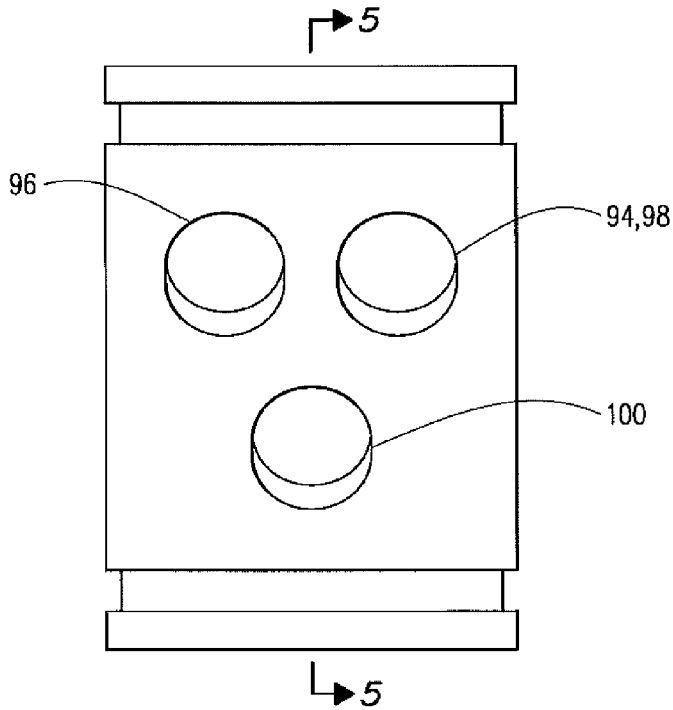
FIG. 4 is a view of the forward face of the slip segment of FIG. 3.
Figure 5:
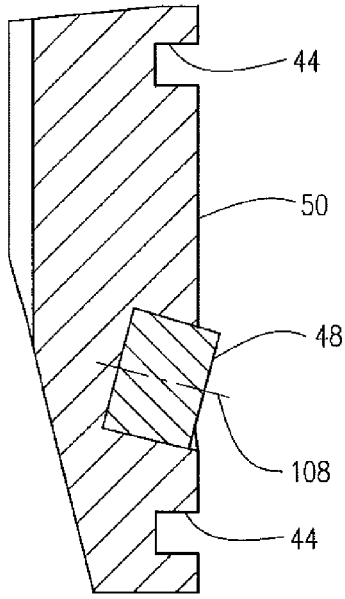
FIG. 5 is a cross-sectional view from line 5-5 of FIG. 4 with an insert, or button installed.
Figure 6:
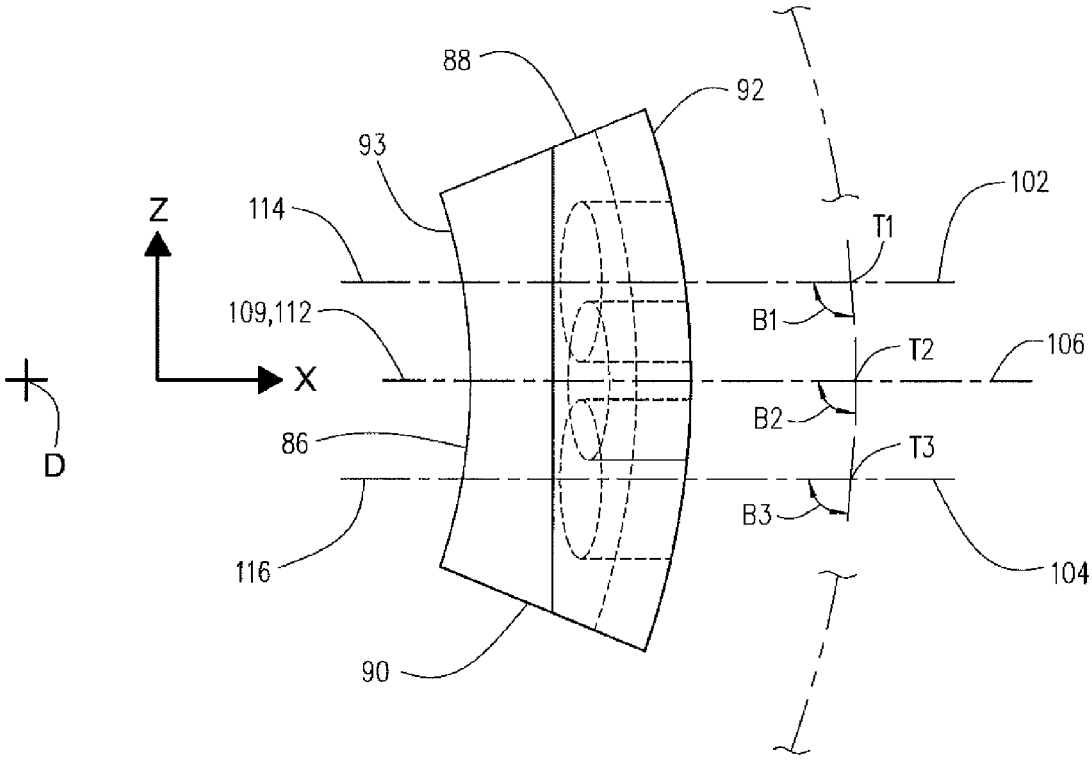
FIG. 6 is an end view of a slip segment of the current disclosure.
Figure 8:
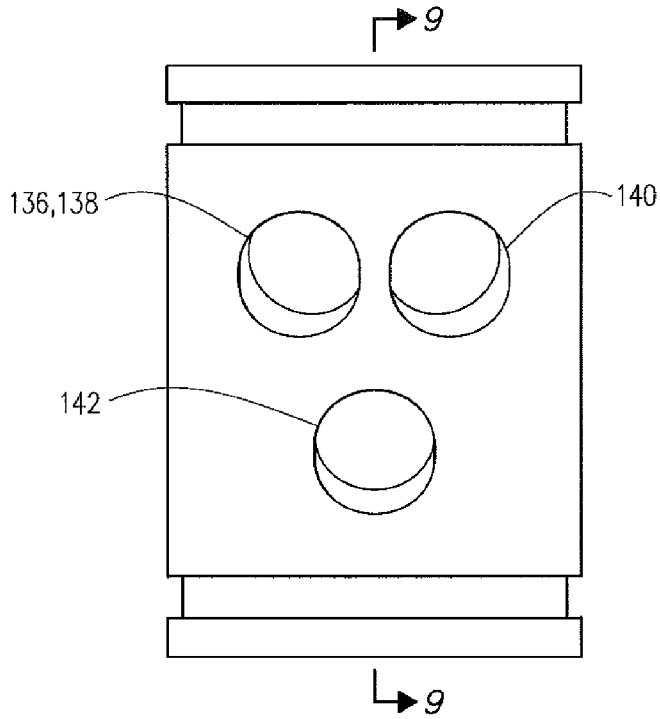
FIG. 8 PRIOR ART
FIG. 8 is a view of the forward face of a prior art slip segment.
Figure 9:
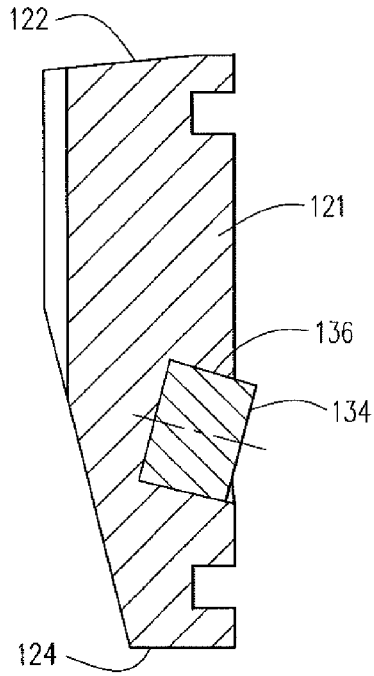
FIG. 9 PRIOR ART
FIG. 9 is a cross-sectional view taken from line 9-9 of FIG. 8.

Referring to FIG. 6, slip segment body 51 has a horizontal bisecting line 109 that rests in a vertical plane 112, perpendicular to the plane of the page as seen in FIG. 6. Longitudinal central axis 106 is collinear with bisecting line 109 and as such also lies in vertical plane 112. Longitudinal central axes 102 and 104 also lie in vertical planes, which may be referred to as vertical planes 114 and 116. Longitudinal axes 102, 104 and 106 thus lie in parallel vertical planes, as do each of the axes 108 of the inserts 48 in a single slip segment 50. Each longitudinal axis of a cavity 94 in a slip segment body 51 is thus angularly displaced from a horizontal axis in one direction only, as shown in FIG. 3, and may be described as such. In other words, as depicted in FIGS. 3 and 6, each of longitudinal central axes 101 will be angled from a horizontal, or X axis in the vertical, or Y direction, but will lie in a vertical plane. Angle 117 may be between 10° and 20°, and may be approximately 15°. The angles provided are exemplary only, and are not limiting. The longitudinal axes 101 are not angled from the horizontal, or X axis in the transverse or Z direction.

FIGS. 7-10 are representative of prior art slip segments which will be referred to as prior art slip segments 120 and show the distinction in the orientation of the prior art inserts, from the orientation of the buttons 48 in slip segments 50. Slip segments 120 comprise slip segment bodies 121 and have first and second ends 122 and 124, which may be referred to as abutment end and free end 122 and 124. An arcuate inner surface 126 will preferably have topology complementary to the outermost surface of the mandrel to which it is mounted. Slip segment body 121 has first and second sides 128 and 130, and has a forward, or outer arcuate face 132.

Figure 7:
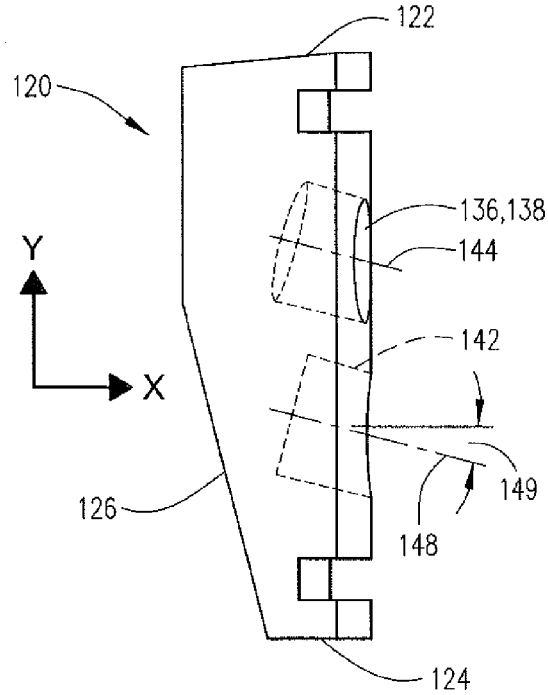
FIG. 7 PRIOR ART
FIG. 7 is a side view of a prior art slip segment.

A plurality of buttons, or inserts 134 are secured to slip segment 120, and extend externally outwardly from outer arcuate face 132. Inserts 134 are shaped substantially identically to inserts 48. Inserts 134 are secured in cavities 136 defined in slip segment body 121. Cavities 136 may be referred to as first, second and third cavities 138, 140 and 142, with longitudinal central axes 144, 146 and 148, respectively. Cavities 138, 140 and 142 are oriented so that longitudinal axes 144, 146 and 148 lie in intersecting vertical planes. When slip segments 120 are positioned vertically, as shown in FIG. 7, each of longitudinal central axes 144, 146 and 148 are angled from a horizontal axis by an angle 149 which may be, for example, approximately 15°. In the rotated view of FIG. 10, longitudinal central axes 144 and 146 are angled in opposite directions from a horizontal axis, and thus will intersect the vertical plane 152 defined by a horizontal axis 150. Longitudinal central axes 144 and 146 lie in vertical planes 145 and 147 respectively. Horizontal axis 150 is collinear with longitudinal central axis 148. Longitudinal axis 148 will lie in plane 152 thus longitudinal central axes 144, 146 and 148 lie in intersecting vertical planes 145, 147 and 152.

In operation, downhole tool 16 is deployed in well 10 using known deployment means such as for example jointed or coiled tubing. Downhole tool 16 will be in an unset position wherein tool 16 does not engage well 10. Thus, neither slip ring 36, nor packer element assembly 60 will engage casing 14 in the unset position. In the unset position, spacer ring 30, both of slip rings 36*a* and 36*b* and slip wedges 38*a* and 38*b* are all in an initial position about mandrel 18 and are positioned radially inwardly from the set position shown in FIG. 1. When downhole tool 16 reaches a desired location in the well, each of slip rings 36*a* and 36*b* are moved radially outwardly to the set position shown in FIG. 1, and tool 16 may be left in well 10. Downhole tool 16 separates well 10 into upper well portion 10*a* and lower portion 10*b*. The upper and lower portions 10*a* and 10*b* are isolated from one another by well tool 16 which in the embodiment shown is a bridge plug.

Retaining rings 42 will retain slip rings 36 in place about mandrel 18 in the unset position prior to being moved to the set position in FIG. 1. Retaining rings 42 will break as slip rings 36*a* and 36*b* move radially outwardly to the set position. Slip rings 36 with slip segments 50, having cavities and inserts 48 as disclosed herein have exhibited greater gripping strength than slips with inserts oriented as in the prior art. Prior art slip segments exhibited the ability to hold a tool in the well with a pressure of approximately 9500 psi, which has a force equivalent of approximately 124,000 pounds. Slip segments 50, with cavities and inserts 48 oriented as described herein, have been shown in tests to hold pressure of approximately 12,200 psi, which has a force equivalent of 160,000 and is a greater than twenty percent increase. The data set forth herein was averaged from five tests for the prior art orientation, and five tests for the new orientation disclosed herein.

Figure 10:
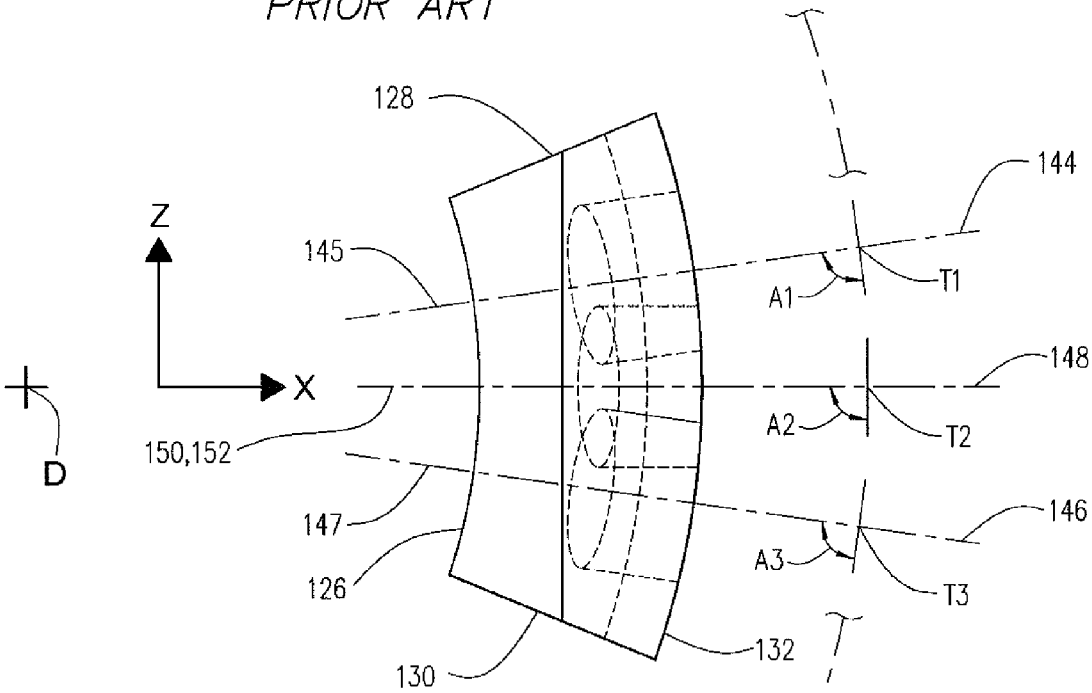
FIG. 10 PRIOR ART
FIG. 10 is an end view of a prior art slip segment.

The orientation described is such that in a slip segment 50, each insert 48 will have an angle of engagement with the well that is different from the angle of engagement for the other of the inserts 48 in a slip segment 50. The angle of engagement B with the well is the angle between the longitudinal central axis of the cavity, and the collinear longitudinal axis of the insert in the cavity, and a tangent T to the well at the point of intersection between the well and the longitudinal central axis of the cavity. Angles $B_1$, $B_2$ and $B_3$ shown in FIG. 6 at the point of intersection for tangents $T_1$, $T_2$ and $T_3$ are not the same, as is the case in the prior art. With a prior art slip segment the angle of engagement A with well 10, which is represented by a dashed line in FIG. 10, is approximately 90 degrees for each insert 134. Each longitudinal central axis of a cavity in the prior art will thus intersect the diametric center D of the arc defined by the outer surface of the slip segment and angles of engagement $A_1$, $A_2$ and $A_3$ are the same. The angles of engagement B, which will be referred to as $B_1$, $B_2$ and $B_3$ of slip segment body 51 are not the same, since the longitudinal central axis of each of the cavities do not intersect, or run through the diametric center D of the arc defined by the outer surface of the slip segment 50, as is the case with the prior art.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. Apparatus for anchoring a downhole tool in a well comprising:

a plurality of slip segments disposed about a mandrel of the tool, the slip segments comprising:

a slip segment body having an outer arcuate face, the slip segment body defining a plurality of cavities therein; and an insert disposed in at least one of the cavities and extending outwardly from the arcuate outer face of the slip segment body, each of the cavities having a longitudinal central axis, the longitudinal central axis of each of said cavities being parallel to the longitudinal central axis of the other of the cavities.

2. The apparatus of claim 1, wherein each of the cavities has an insert disposed therein.

3. The apparatus of claim 1, wherein the longitudinal central axis of each cavity is angled from a horizontal axis in one direction only.

4. The apparatus of claim 1, wherein the vertical plane in which each longitudinal axis lies is parallel to the vertical planes in which the other of longitudinal axes lie.

5. A downhole tool for use in a well comprising:

a mandrel;

a plurality of slip segments disposed about the mandrel movable from an unset position to a set position in which the slip segments engage the well, the slip segments comprising:

a slip segment body defining a plurality of cavities therein and having an outer arcuate face; and an insert affixed in at least one of the cavities, wherein the longitudinal axis of each of the cavities is oriented such that it lies in a vertical plane parallel to the vertical planes in which the longitudinal axes of the other cavities lie and wherein the insert extends outwardly from the outer arcuate face of the body.

6. The downhole tool of claim 5, wherein the longitudinal axis of each cavity is parallel to the longitudinal axis of each of the other cavities.

7. The tool of claim 5, wherein each cavity has an insert therein.

8. The tool of claim 7, wherein the inserts are cylindrically shaped.

9. The tool of claim 5, wherein the longitudinal central axis of each cavity is angled from a horizontal axis in only one direction.

10. A downhole tool for use in a well comprising:

a mandrel;

an expandable sealing element disposed about the mandrel for sealingly engaging the well; and a plurality of slip segments disposed about the mandrel for grippingly engaging the well, each slip segment comprising:

a slip segment body defining an outer face; and a plurality of inserts extending outwardly from the outer face, wherein each insert in a slip segment body will engage the well at an angle of engagement different than the angle of engagement of other inserts in the slip segment body.

11. The downhole tool of claim 10, wherein each slip segment body defines a plurality of cavities, and wherein the inserts are affixed to the slip segment bodies in the cavities.

12. The downhole tool of claim 11, each cavity having a longitudinal central axis, and each longitudinal axis being substantially parallel to the longitudinal axis of each of the other cavities.

13. The downhole tool of claim 11, wherein a longitudinal axis of each cavity lies in a vertical plane parallel to that plane that bisects the segment, or lies in a plane parallel to such vertical bisecting plane.

14. The downhole tool of claim 10, comprising a first set of slip segments disposed about the mandrel above the sealing element and a second set of slip elements disposed about the mandrel below the sealing element.

* * * * *